United States Patent [19]

Dwinell et al.

[11] 4,442,949

[45] Apr. 17, 1984

[54] TEAR OPEN CLOSURE ASSEMBLY

[75] Inventors: Davis B. Dwinell, Warren; Jeremiah J. Laurizio, New Providence, both of N.J.

[73] Assignee: American Flange & Manufacturing Co. Inc., Linden, N.J.

[21] Appl. No.: 476,999

[22] Filed: Mar. 21, 1983

[51] Int. Cl.[3] ..... B65D 49/12

[52] U.S. Cl. ..... 220/257; 220/258; 220/270; 222/541; 222/527

[58] Field of Search ..... 220/257, 258, 270, 855 P; 222/541, 527, 249, 529, 537, 531, 538, 532; 215/249

[56] References Cited

U.S. PATENT DOCUMENTS

| | | | |
|---|---|---|---|
| 3,239,112 | 3/1966 | Porcelli | 220/258 |
| 3,458,080 | 7/1969 | Laurizio | 220/258 |
| 4,146,148 | 3/1979 | Dwinell et al. | 220/270 |
| 4,320,861 | 3/1982 | Rieke et al. | 222/541 |

*Primary Examiner*—George T. Hall

[57] ABSTRACT

A nestable spout assembly for dispensing liquid products from cans and pails. A molded plastic spout in extended position has an enlarged flexible lower wall portion joined to a relatively rigid externally threaded upper wall portion. A peripheral sealing channel is disposed about the base of the lower wall portion for securing to a container wall opening neck by means of an overlying metal crimping ring. A tear out diaphragm is recessed within the upper end of the spout and is provided with an integrally molded ring pull for removal. A circumferentially enlarged plastic reclosing cap threadedly engages the spout upper wall portion and also interlockingly engages the metal crimping ring with the spout in nested position to close off the annular spout void against contamination. An axially extending support member is disposed within the space between the upper surface of the diaphragm and the under surface of the reclosing cap.

10 Claims, 5 Drawing Figures

TEAR OPEN CLOSURE ASSEMBLY

BACKGROUND OF THE INVENTION

One type of pouring spout commonly found on industrial size pails and cans consists of a collapsible plastic spout having a flexible wall portion which allows the spout to be raised from a compact stored or nested condition to a fully extended pouring position. The spout neck is exteriorly threaded to receive a screw cap for reclosing. To assure against leakage and pilfering under shipping or storage conditions, the spout neck is initially closed off with an integrally formed sealing diaphragm. In the interest of convenience and sanitary opening, these diaphragms are commonly not cut out with a knife but instead are provided with a peripheral tearing zone or score line and a pull member for removal.

A close structure balance must be maintained in determining the proper thickness of remaining plastic material at the peripheral score line. If this thickness is too great, tearing becomes difficult and erratic. If too thin, accidental rupturing will occur. This structure balance has now become even more critical with the more recent need to meet UN (IMCO) packaging requirements calling for a six foot drop test. Dropping a fluid filled five gallon pail equipped with the closure from a height of six feet creates a substantial rupturing force by the fluid acting on the diaphragm and transmitted to that thin tearing zone of plastic surrounding the sealing diaphragm. At the moment of impact, this force causes a severe deflection or bulging of the disc like sealing diaphragm such that rupture at the intentionally weakened tearing zone will frequently occur. Avoidance of tearing zone rupture is the principal concern of this invention.

SUMMARY OF THE INVENTION

This invention is directed to a tear out diaphragm closure assembly for dispensing liquid products from containers.

The inherent prior art weakness described above is effectively overcome by the invention closure assembly, one form of which consists of a plastic closure secured about its periphery to a container opening neck by means of an overlying metal crimping ring. The closure has a central pouring opening closed off by an integrally molded recessed sealing diaphragm surrounded by a weakened tearing zone. A pull member to facilitate tearing is integrally connected to the diaphragm periphery and overlies the diaphragm in stored position. The closure assembly is completed with the provision of a cap which overlies the pouring opening and creates a space above the diaphragm for storing the pull member. In accordance with this invention there is disposed within this space a support member designed to substantially maintain the spacing between diaphragm and cap.

The advantage offered by this invention construction becomes apparent should a pail be dropped on its head normally causing the sealing diaphragm to deflect upwardly and outwardly with resultant severe stress at the tearing zone. Restriction of this severe deflection by the support member of the invention acting between the diaphragm and the cap, protects against the effect of disruptive forces at the tearing zone. The likelihood of accidental rupturing of the tearing zone is substantially eliminated.

It is accordingly a principal object of the invention to provide a new and improved container closure assembly, employing a tear out sealing diaphragm, including provision for preventing severe deflection of the diaphragm in the response to a sudden applied force.

Another object is to protect the tearing zone around said diaphragm from rupture by the action of such force on said diaphragm.

Another object is to provide such deflection prevention without interferring with access to, and actuation of the tearing means for removing such diaphragm.

Another object is to house such deflection preventing means within the space between the diaphragm and cap of such closure.

Other and more detailed objects will in part be obvious and in part be pointed out as the description taken in conjunction with the accompanying drawing proceeds. In that drawing:

DESCRIPTION OF THE PREFERRED EMBODIMENTS

Figure 1:
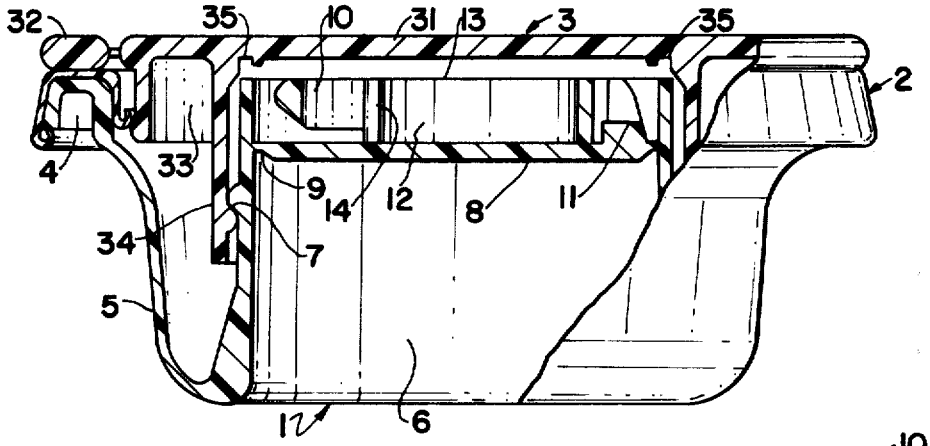
FIG. 1 is a part elevational part sectional view of a nestable pouring spout closure assembly in accordance with the invention shown in nested position.
Figure 2:
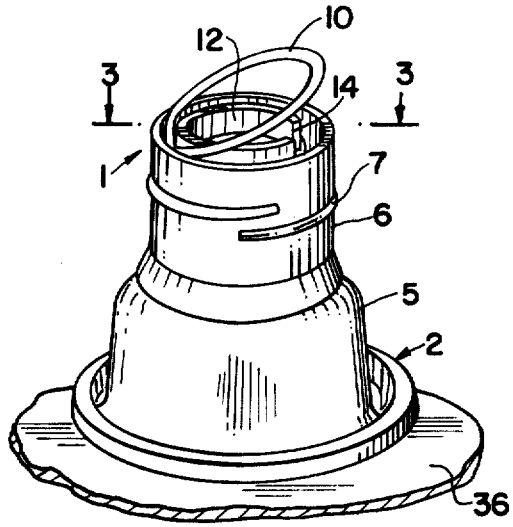
FIG. 2 is a perspective view of the pouring spout closure assembly of FIG. 1 with cap removed and showing one form of deflection preventing means.
Figure 3:
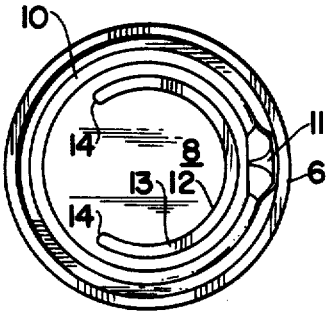
FIG. 3 is taken along lines 3—3 in FIG. 2 and looking in the direction of the arrows.

The principal form of the invention shown in FIGS. 1–3 is a closure assembly for application to a container wall opening neck consisting of a molded plastic closure 1, a metal securing ring 2, and a molded plastic overcap 3.

The closure 1 as shown in FIG. 1 is in the form of a nestable spout having a peripheral inverted sealing channel 4 at its base. The metal crimping ring 2 has an inverted channel shaped cross section to overlie and snugly receive the sealing channel 4 therewithin. In nested or stored position a relatively flexible outer wall 5 extends from the sealing channel 4 to the lower end of a relatively rigid upstanding spout neck 6. A screw thread 7 is formed on the neck exterior mid-section. Immediately above the position of the thread, the spout neck interior or fluid passage is closed off by an integrally molded sealing diaphragm 8. A weakened tearing zone 9 in the form of a score line of reduced cross sectional thickness surrounds the diaphragm 8. A ring pull 10 suitable for grasping with a finger closely overlies the diaphragm in a horizontal plane and is integrally joined to the periphery of the diaphragm adjacent to the tearing zone 9 by means of a connecting boss 11.

In accordance with the invention a deflection preventing support member 12 is integrally connected to the upper surface of the sealing diaphragm 8. The member 12 consists of a "C" shaped open cylindrical wall disposed within the ring pull 10 having a top edge 13 lying in the plane of the spout open end and having vertical end surfaces 14. The "C" shaped wall 12 is positioned so that the space between the end walls 14 is diametrically opposite the ring pull connection 11 so as to provide easy access to the finger ring 10 for diaphragm removal.

The plastic overcap 3 has a circumferentially enlarged top wall 31 surrounded by a pair of hinged lifting bails 32 which overlie the metal ring 2 when they are in their initial stored position with the spout retracted. A cylindrical skirt 33 depends from the cap top periphery and interlockingly engages the ring 4. An internally threaded cylindrical sidewall 34 also depends from the cap top for threaded engagement with the spout neck 6. Full thread engagement and subsequent reclosing after the diaphragm is torn out, is achieved upon seating the uppermost end of the spout neck within the downwardly opening annular groove 35 disposed inside the sidewall 34.

As clearly seen in FIG. 1, the assembled closure becomes a tightly interfitting unit creating a cylindrical space or compartment between the diaphragm 8 and the cap wall 31 within which space the ring pull 10 is stored. In use, the closure assembly is crimped onto the opening of a filled container such as a five gallon pail indicated at 36, FIG. 2. For regulatory use this package must meet UN (IMCO) regulations calling for a six foot drop test on the closure with the container filled with water. The internal force from the contents at impact causes the diaphragm 8 to bulge outwardly placing the thin weakened tearing zone 9 under considerable stress. Under these conditions the support wall 12 of the invention becomes effective to restrain the diaphragm against severe deflection by maintaining a predetermined spacing between the diaphragm and overcap. As a result, the stress exerted on the tearing zone 9 is materially minimized and detrimental rupturing of the tearing zone 9 avoided.

Figure 4:
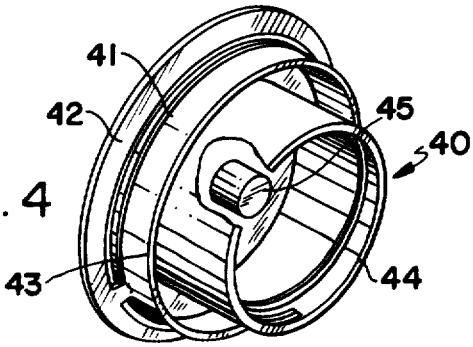
FIG. 4 is a modified over cap providing alternate deflection preventing means to that shown in FIG. 1.

FIG. 4 shows a modified form of overcap 40 which, like the principal embodiment, has a circumferentially enlarged top wall 41 surrounded by hinged lifting bails 42. Overcap 40 also has an outer skirt 43 and an inner threaded sidewall 44. As an alternative restraining means in accordance with the invention, a central axially enlongated stud 45 is formed to extend downwardly from the interior surface of the cap top wall 41 to substantially engage diaphragm 8. When the cap 40 is used in place of the cap 3, the diaphragm support wall 12 may be eliminated relying upon the stud 45 to provide the desired spacing between the cap and diaphragm. In this arrangement the stud 45 is simply integrally connected to the cap top wall instead of to the spout diaphragm. Since the cap is removed prior to tearing the diaphragm out, having the stud centrally disposed presents no problem of interference with the ring pull 10.

Figure 5:
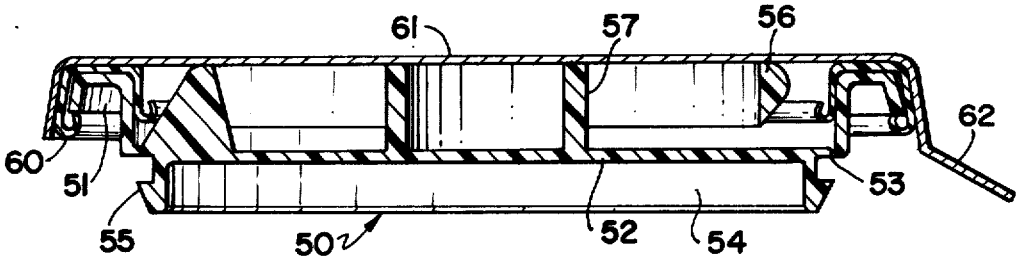
FIG. 5 is a modified closure assembly also in accordance with the invention.

FIG. 5 shows a further modified closure assembly in accordance with the invention comprising a plastic closure 50 having a peripheral inverted sealing channel 51 as in the principal embodiment. A center tear out panel 52 is joined to the sealing channel 51 by a circular tearing zone 53. A short circumferential skirt 54 depends from the under surface of the panel 52 having an external locking shoulder 55. An enlarged ring pull 56 is integrally connected to the upper surface of the tear out panel 52. The panel support member in this embodiment of the invention consists of a short upstanding cylinder 57 integrally connected to the upper surface of the panel 52. Because of the relatively large diameter of the ring 56, with respect to the member 57, adequate spacing remains between the ring 56 and the closed cylindrical support member 57 to easily grasp the ring for tearing. A metal crimping ring 60 overlies the sealing channel 51 and the assembly is completed with the provision of a lightweight metal tear off overcap 61 having a gripping ear 62 to facilitate its removal. In use, the complete assembly is crimped onto the opening of a filled container with protection against diaphragm rupture being afforded by the support member 57 acting between the tear out panel 52 and the overcap 61. Reclosing may be accomplished by simply pushing the relatively flexible panel 52 and locking shoulder 55 back into the opening from above.

An added degree of product protection is brought about by the above described invention in that the tearing zone by design, necessarily the weakest part of the container, can now withstand the impact and abuse required to meet current packaging standards. By controlling the diaphragm to cap spacing, severe deflection of the diaphragm in response to impact is prevented. The end result is a sealed tamper indicating closure which can be easily torn open yet able to withstand severe impact forces without diaphragm disruption.

Various other changes in or modifications of the closure assembly and different embodiments of the invention would suggest themselves to those skilled in the art and could be made without departing from the spirit or scope of the invention. It is accordingly intended that all matter contained in the above description or shown in the accompanying drawing shall be interpreted as illustrative and not in a limiting sense.

We claim:

1. In container closure construction, a molded plastic closure having container wall engaging means, a fluid passage closed off by an integrally molded sealing diaphragm, said diaphragm including a weakened tearing zone, a pull member integrally connected to said diaphragm, a closure cap overlying said fluid passage so as to create a void within which the pull member is housed and support means within said void adapted to restrain said diaphragm against excessive deflection in response to instantaneous pressure surge.

2. Container closure construction as in claim 1, and including a metal securing ring overlying said container wall engaging means.

3. Container closure construction in claim 1, wherein said support means is spaced radially inwardly from said tearing zone.

4. Container closure construction as in claim 1, wherein said pull member has a ring configuration surrounding said support means.

5. Container closure construction as in claim 1, wherein said closure includes a nestable pouring spout with said closure cap secured thereto.

6. Container closure construction as in claim 2, wherein said closure cap engages said metal securing ring.

7. Container closure construction as in claim 1, wherein said support means is integrally connected to said sealing diaphragm.

8. Container closure construction as in claim 1, wherein said support means is a hollow curved wall.

9. Container closure construction as in claim 1, wherein said support means is integrally connected to said closure cap.

10. In container closure construction, a molded plastic closure having circumferentially disposed container wall engaging means, a central fluid passage closed off by a recessed integrally molded sealing diaphragm, a weakened tearing zone of reduced cross sectional thickness surrounding said diaphragm, a pull member integrally connected to said diaphragm adjacent said tearing zone and substantially overlying said diaphragm, a closure cap forming part of said closure construction and overlying said fluid passage in spaced relation to said diaphragm so as to create a cylindrical void within which said pull member is housed and axially extending support means within said void adapted to restrain said diaphragm against excessive deflection in response to instantaneous pressure surge.

* * * * *